US010534324B2

(12) United States Patent
Chung et al.

(10) Patent No.: US 10,534,324 B2
(45) Date of Patent: Jan. 14, 2020

(54) ELECTRONIC DEVICE

(71) Applicant: Samsung Electronics Co., Ltd., Gyeonggi-do (KR)

(72) Inventors: In-Sik Chung, Seoul (KR); Yong-Seok Bang, Gyeonggi-do (KR); Mi-Ri Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/743,902

(22) PCT Filed: Jul. 11, 2016

(86) PCT No.: PCT/KR2016/007498
§ 371 (c)(1),
(2) Date: Jan. 11, 2018

(87) PCT Pub. No.: WO2017/026670
PCT Pub. Date: Feb. 16, 2017

(65) Prior Publication Data

US 2018/0203418 A1 Jul. 19, 2018

(30) Foreign Application Priority Data

Aug. 7, 2015 (KR) ..... 10-2015-0111860

(51) Int. Cl.
*G04G 21/00* (2010.01)
*G04G 17/04* (2006.01)
*G04G 21/08* (2010.01)

(52) U.S. Cl.
CPC ..... *G04G 21/00* (2013.01); *G04G 17/04* (2013.01); *G04G 21/08* (2013.01)

(58) Field of Classification Search
CPC ..... G04G 21/00; G04G 17/04; G04G 17/08; G04G 21/08; G04B 19/16; G04B 19/283;
(Continued)

(56) References Cited

U.S. PATENT DOCUMENTS 4,815,053 A 3/1989 Dal Busco
5,319,617 A * 6/1994 Sonoda ..... G04B 19/286 368/294

(Continued)

FOREIGN PATENT DOCUMENTS

CN 104460287 A 3/2015
CN 104678753 A 6/2015

(Continued)

OTHER PUBLICATIONS

European Search Report dated Aug. 13, 2018.
Chinese Search Report dated Jun. 26, 2019.

*Primary Examiner* — Edwin A. Leon
(74) *Attorney, Agent, or Firm* — Cha + Reiter, LLC.

(57) ABSTRACT

An electronic device according to various embodiments of the present invention may comprise: a housing; a display device mounted on a surface of the housing; a bezel, which is rotatably coupled to the housing, and which rotates along the circumference of the display device; and elastic portions provided on the housing so as to provide the bezel with an elastic force in a first direction. The above electronic device may be implemented variously according to embodiments.

7 Claims, 4 Drawing Sheets

(58) Field of Classification Search
CPC .... G04B 19/223; G04B 19/28; G04B 19/238; G04B 29/286
USPC ..... 368/224, 294–296, 21–22, 27, 223, 233
See application file for complete search history.

(56) References Cited

U.S. PATENT DOCUMENTS

| | | | | |
|---|---|---|---|---|
| 6,616,329 | B1 * | 9/2003 | Sasaki | G04B 19/283 368/294 |
| 7,635,219 | B2 * | 12/2009 | Seyr | G04B 37/0427 368/283 |
| 7,639,568 | B2 * | 12/2009 | Lin | G04B 19/223 368/22 |
| 8,777,480 | B2 * | 7/2014 | Silvant | G04B 19/286 368/295 |
| 2002/0101457 | A1 | 8/2002 | Lang | |
| 2004/0113819 | A1 | 6/2004 | Gauthey et al. | |
| 2006/0280040 | A1 | 12/2006 | Bourban et al. | |
| 2015/0085627 | A1 | 3/2015 | Hiranuma et al. | |
| 2015/0227113 | A1 * | 8/2015 | Cattaneo | G04B 19/223 368/295 |

FOREIGN PATENT DOCUMENTS

| | | | |
|---|---|---|---|
| CN | 104834206 | A | 8/2015 |
| KR | 10-0685218 | B1 | 2/2007 |
| KR | 10-2014-0138361 | A | 12/2014 |
| KR | 10-2015-0081169 | A | 7/2015 |
| WO | 2004/012178 | A1 | 2/2004 |

* cited by examiner

ELECTRONIC DEVICE

CLAIM OF PRIORITY

This application is a National Phase Entry of PCT International Application No. PCT/KR2016/007498, which was filed on Jul. 11, 2016, and claims a priority to Korean Patent Application No. 10-2015-0111860, which was filed on Aug. 7, 2015, the contents of which are incorporated herein by reference.

TECHNICAL FIELD

Various embodiments of the present disclosure relate to an electronic device, for example, an electronic device which is wearable on a portion of a human body.

BACKGROUND ART

The term "electronic device" refers to a device that performs a specific function according to an equipped program, such as an electronic scheduler, a portable multimedia reproducer, a mobile communication terminal, a tablet PC, an image/sound device, a desktop/laptop PC, or a vehicular navigation system, including home appliances. For example, such an electronic device may output information stored therein as sound or an image. As the degree of integration of such electronic devices has increased, and super-high speed and large-capacity wireless communication has become popular, various functions have recently been provided in a single mobile communication terminal. For example, various functions, such as an entertainment function (e.g., a game function), a multimedia function (e.g., a music/video reproducing function), a communication and security function for mobile banking, a schedule management function, and an e-wallet function, are integrated in a single electronic device, in addition to a communication function.

A portable-purpose electronic device (e.g., an electronic scheduler, a portable multimedia reproducer, a mobile communication terminal, or a tablet PC) is generally equipped with a flat display device and a battery. In recent years, as the performance of a display device and a battery has been improved, electronic devices, which are miniaturized to be capable of being worn on a part of a human body, such as a wrist or a head, have appeared.

There are various kinds of input devices of such electronic devices. For example, a desktop computer or the like includes an input device, such as a keyboard or a mouse, and a home appliance may be provided with a remote-control device. In an electronic device, such as a mobile communication terminal, a microphone, or a keypad is used as a conventional input device, and in a laptop computer, a touch pad is used as an input device to replace a mouse. Such a touch pad may be typically realized in an electrostatic capacitance type to be capable of detecting a touch of a user's body (e.g., a finger).

DETAILED DESCRIPTION OF THE INVENTION

Technical Problem

The touch pad of an electronic device is able to transmit feedback based on a user's touch using a haptic technology. However, when such a haptic technology is applied to a touch pad, the structure of the touch pad becomes complicated, which may degrade the touch sensitivity of the touch pad.

In addition, an input device for providing an analog feeling to a user is demanded in addition to the touch pad of the electronic device.

Accordingly, various embodiments of the present disclosure provide an electronic device capable of providing physical tactile sensation to a user using an input device.

Technical Solution

According to various embodiments of the present disclosure, an electronic device may include:

a housing;

a display device mounted on one face of the housing;

a bezel rotatably coupled to the housing and rotating along a periphery of the display device; and a plurality of elastic units provided in the housing so as to provide an elastic force to the bezel in a first direction.

Advantageous Effects

The electronic device according to various embodiments of the present disclosure is able to provide a physical sensation to the user who rotates the bezel since the resilient units provide an elastic force to the bezel in the first direction.

In addition, the electronic device according to various embodiments of the present disclosure includes a sensor unit that senses the degree of rotation of the bezel. Thus, the bezel can be used as an input device.

BRIEF DESCRIPTION OF DRAWINGS

The above and other aspects, features and advantages of the present disclosure will be more apparent from the following detailed description taken in conjunction with the accompanying drawings, in which.

Figure 1:
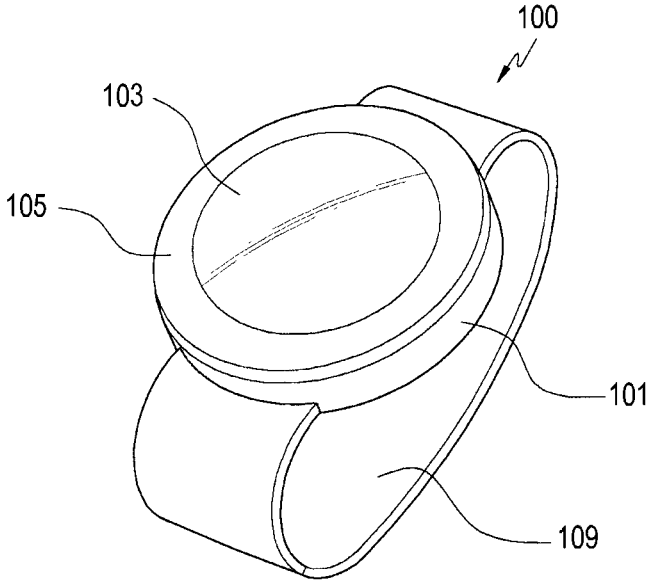
FIG. 1 is a perspective view illustrating an electronic device according to a first one of various embodiments of the present disclosure.

| | |
|---|---|
| 100: electronic device | 101: housing |
| 103: display device | 105: bezel |
| 107: elastic unit | 109: wearing unit |

MODE FOR CARRYING OUT THE INVENTION

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

In the present disclosure, the expression "have", "may have", "include" or "may include" refers to existence of a corresponding feature (e.g., numerical value, function, operation, or components such as elements), and does not exclude existence of additional features.

In the various embodiments of the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The terms used herein are merely for the purpose of describing particular embodiments and are not intended to limit the scope of other embodiments. A singular expression may include a plural expression unless they are definitely different in a context. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the present disclosure. In some cases, terms defined in this specification may not be interpreted as excluding embodiments of the present disclosure.

FIG. 1 is a perspective view illustrating an electronic device according to one of various embodiments of the present disclosure.

Referring to FIG. 1, according to a first one of various embodiments of the present disclosure, an electronic device 100 may include a housing 101, a display device 103, a bezel 105, and a wearing unit 109. The electronic device may be any of various electronic devices, such as a portable terminal, a smartwatch, and a multimedia device. In the present embodiment, a smartwatch will be described as an example.

The housing 101 may protect the inside of the electronic device 100 while forming the external appearance of the electronic device 100. The housing 101 may be made of a plastic material, for example, a polycarbonate material. However, the housing 101 is not limited to the polycarbonate material, but may be made of various plastic materials. Also, the housing 101 may be made of a metallic material. In addition, a portion of the housing 101, for example, the rim of the housing may be made of a metallic material, and other portions of the housing may be made of a resin. The metal housing 101 or a portion of the housing 101 may be used as a radiator of an antenna of the electronic device 100. In addition, a circuit board is provided inside the housing 101, and the circuit board may perform a function of a main circuit board by being mounted with a control unit, a communication circuit unit, and the like required for driving the electronic device 100. A circuit board and a battery may be provided inside the housing 101. In addition, the housing 101 may include components for driving the electronic device, such as an antenna and a communication module.

The display device 103 may be provided on one face of the housing 101, for example, on the front face of the housing 101, and may include a window member and a touch panel. The window member may transmit a screen output through the display device 102 while protecting the interior of the display device 102. In addition, the window member may be integrally formed with the touch panel so as to provide a function of the input device.

The bezel 105 may be rotatably coupled to the housing 101 such that the bezel 105 may be rotated clockwise or counterclockwise along the periphery of the display device 103. The bezel 105 may be made of a metallic material. However, the bezel 105 is not limited to being made of a metallic material, and may be made of various materials such as a rigid plastic material. In addition, the display device 103 may have a circular shape, and the bezel 105 may have a shape corresponding to the periphery of the display device 103.

The wearing unit 109 is connected to the housing 101 and may be detachably worn on the user's body, for example, the wrist. The wearing unit 109 is formed in the form of wrapping the wrist and may be connected to opposite side faces of the housing 101. However, the wearing unit 109 is not limited to a single band form, and may include an adjustment unit that adjusts the length of the wearing unit while being connected to the opposite side faces of the housing 101 in a two-band form.

As such, according to various embodiments of the present disclosure, since the bezel 105 is rotated around the display device 103, the electronic device 100 generates various input signals according to the rotation of the bezel 105. For example, the bezel 105 may be rotated clockwise in order to change the application implemented in the display device 103 to another application.

Figure 2:
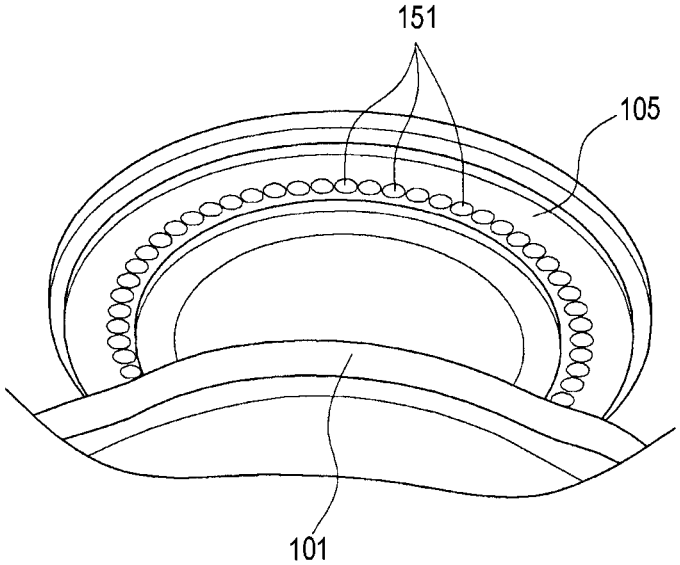
FIG. 2 is a rear perspective view illustrating a bezel of the electronic device according to the first one of various embodiments of the present disclosure.
Figure 3:
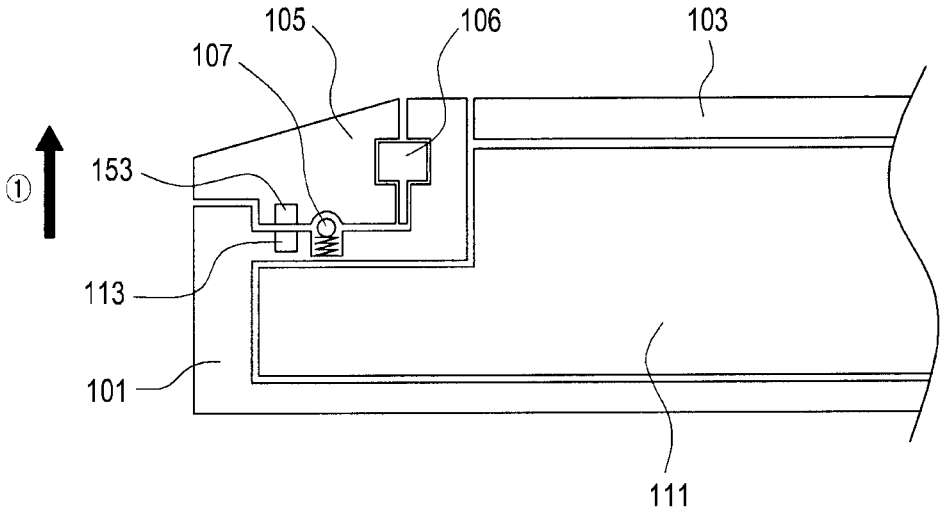
FIG. 3 is a cross-sectional view illustrating the electronic device according to the first one of various embodiments of the present disclosure.
Figure 4:
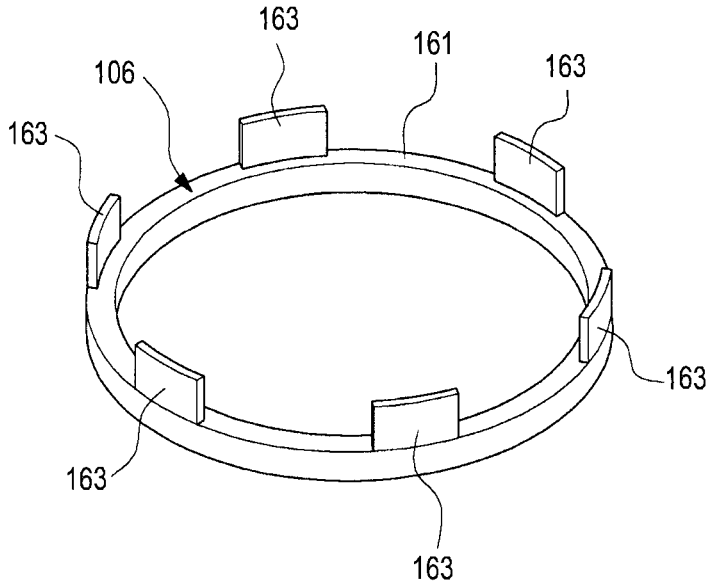
FIG. 4 is a perspective view illustrating a connecting unit of the electronic device according to the first one of various embodiments of the present disclosure.
Figure 5:
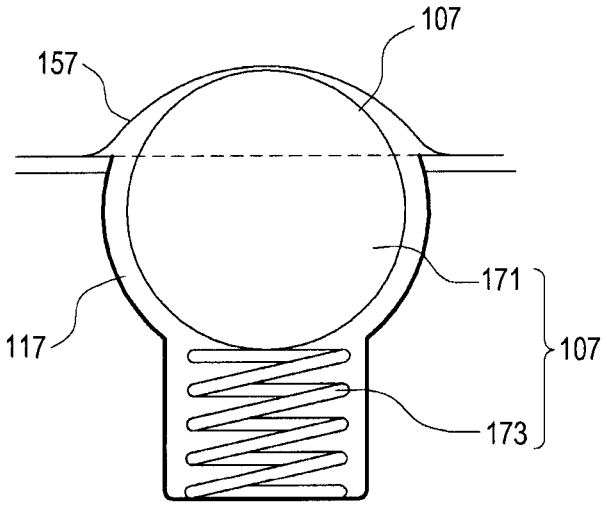
FIG. 5 is a cross-sectional view illustrating an elastic unit of the electronic device according to the first one of various embodiments of the present disclosure.

FIG. 2 is a rear perspective view illustrating a bezel of the electronic device according to the first one of various embodiments of the present disclosure. FIG. 3 is a cross-sectional view illustrating the electronic device according to the first one of various embodiments of the present disclosure. FIG. 4 is a perspective view illustrating a connecting unit of the electronic device according to the first one of various embodiments of the present disclosure. FIG. 5 is a cross-sectional view illustrating an elastic unit of the electronic device according to the first one of various embodiments of the present disclosure.

Referring to FIGS. 2 to 5, a structure of rotating the bezel of the electronic device according to a first one of various embodiments of the present disclosure will be described in more detail.

The bezel 105 is rotatable in the state of being accommodated in one face of the housing 101, for example, a portion of the front face of the housing 101.

In addition, the electronic device according to the first one of the various embodiments of the present disclosure may further include a connecting unit 106 between a side face of the bezel 105 and a side face of the housing 101, which faces the side face of the bezel 105.

The bezel 105 may include a first connecting groove formed on a side face thereof, and the housing 101 may include a second connecting groove, which faces the first connecting groove.

The connecting unit 106 may be provided in the first connecting groove and the second connecting groove such that the bezel 105 can be held in the state of being accommodated in the front face of the housing 101. In addition, the connecting unit 106 may be made of polyoxymethylene (POM). However, the connecting unit 106 is not limited to being made of the polyoxymethylene, and may be made of an elastic plastic material having mechanical rigidity. When the bezel 105 rotates in the state of being accommodated in the front face of the housing 101, the connecting unit 106 is able to prevent the bezel 105 and the housing 101 from being worn out by coming in contact with each other while preventing the bezel 105 from being detached from the housing 101. The connecting unit 106 may include first connecting portion 161 inserted into the first connecting groove and the second connecting groove, and second connecting portions 163 extending from the first connecting portion 161. The second connecting portions 163 may be spaced apart from each other along the first connection portion 161. The second connecting portions 163 are provided between the side surface of the bezel 105 and the side surface facing the housing 101 to prevent the bezel 105 and the housing 101 from coming into contact with each other and from being worn out.

The housing 101 may have an accommodation space 111 for accommodating electronic components, such as a circuit board and a battery. The housing 101 may include elastic units 107 to face the front face of the bezel 105. The elastic units 107 may be disposed along the periphery of the display device. The elastic units 107 may provide an elastic force to the bezel 105 in a first direction, which is the forward direction of the housing 101 (as indicated by the arrow in FIG. 3). Each elastic unit 107 may include a first elastic section 171, at least a portion of which include a curved surface, and a second elastic section 173 that provides an elastic force to the first elastic portion 171. The first elastic section 171 may have a spherical shape as illustrated in FIG. 5, and may be provided in a first groove 117 formed in the housing 103. The second elastic section 173 may be provided in the groove 117 formed in the housing 103 so as to provide an elastic force to the first elastic section 171 in the first direction in the first groove 117. The second elastic section 173 may be a spring. However, the second elastic portion 173 is not limited to the spring, but may be formed of various members that provide an elastic force to the first elastic section 171.

The bezel 105 may have second grooves 151 (FIG. 2), which correspond to the elastic units 107, respectively. The elastic units 107 are sequentially and repeatedly inserted into and separated from the second grooves 151 when the bezel 105 rotates, so that the mechanical sensation can be transmitted to the user who rotates the bezel 105. In addition, each of the second grooves 151 may have a contact surface 157 (FIG. 5), which comes into contact with the curved surface of the first elastic section 171. The contact surface 157 has a curvature smaller than that of the curved surface of the first elastic section 171 so that the elastic units 107 can be easily inserted into or separated from the second grooves 151.

In addition, the electronic device according to the first one of the various embodiments of the present disclosure may include a magnet 153 installed in the bezel 105 and a sensor unit 113 installed in the housing 101. As the relative position between the housing 101 and the bezel 105 changes with the rotation of the bezel 105, the relative distance with respect to the magnet 153 changes so that a changed magnetic force can be detected. For example, when the sensor unit 113 is separated from the magnet 153, the magnetic force sensed by the sensor unit 113 may be reduced. That is, the sensor unit 113 senses the degree of rotation of the bezel 105 by sensing a change in the magnetic force of the magnet 153. However, the magnet 153 is not limited to being installed in the bezel 105, and the sensor unit 113 may be installed in the bezel 105 while the magnet is installed in the housing 101.

Further, the electronic device according to the first one of the various embodiments of the present disclosure may include a control unit.

The control unit may be mounted on a circuit board of the housing 101 so as to receive an electrical signal from the sensor unit 113. At this time, the electrical signal may have a value corresponding to the magnetic force sensed by the sensor unit 113. Accordingly, the control unit may convert an electrical signal, which changes according to the rotation of the bezel 105, into an input signal for driving the electronic device. For example, the input signal may increase or decrease the volume of a music application implemented in the electronic device.

Figure 6:
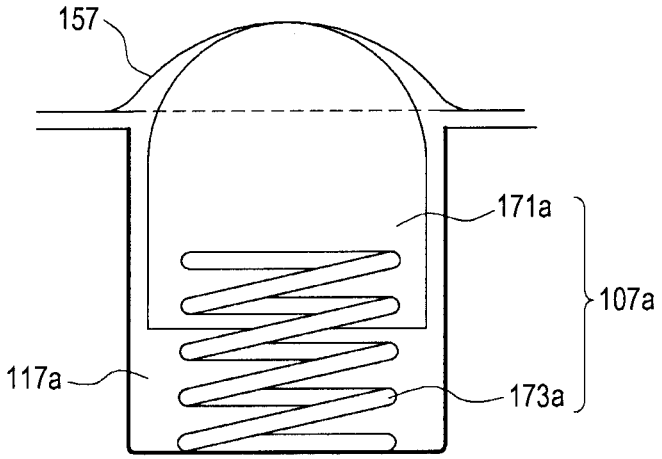
FIG. 6 is a cross-sectional view illustrating an elastic unit of an electronic device according to a second one of various embodiments of the present disclosure.

FIG. 6 is a cross-sectional view illustrating an elastic unit of an electronic device according to a second one of various embodiments of the present disclosure.

Referring to FIG. 6, an elastic unit 107*a* of the electronic device according to the second one of the various embodiments of the present disclosure may include a first elastic section 171*a*, which has a curved face that is in contact with the second groove 151 (FIG. 2) of the bezel, unlike that in the previous embodiment, and the remaining portion of the first elastic section 171*a* may be formed in a cylindrical shape. In addition, the first groove 117*a* may be configured in the form in which the first elastic section 171*a* including the cylindrical shape can be accommodated.

Figure 7:
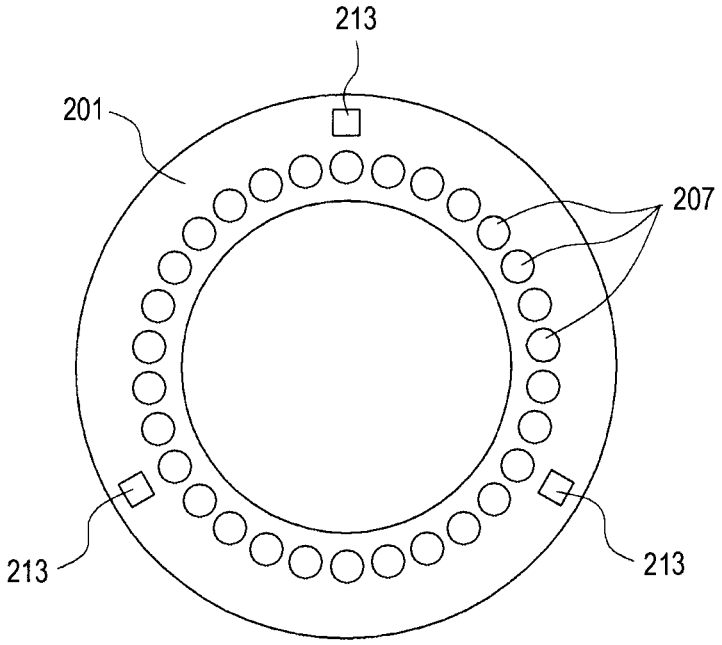
FIG. 7 is a front view illustrating a housing of an electronic device according to a third one of various embodiments of the present disclosure.
Figure 8:
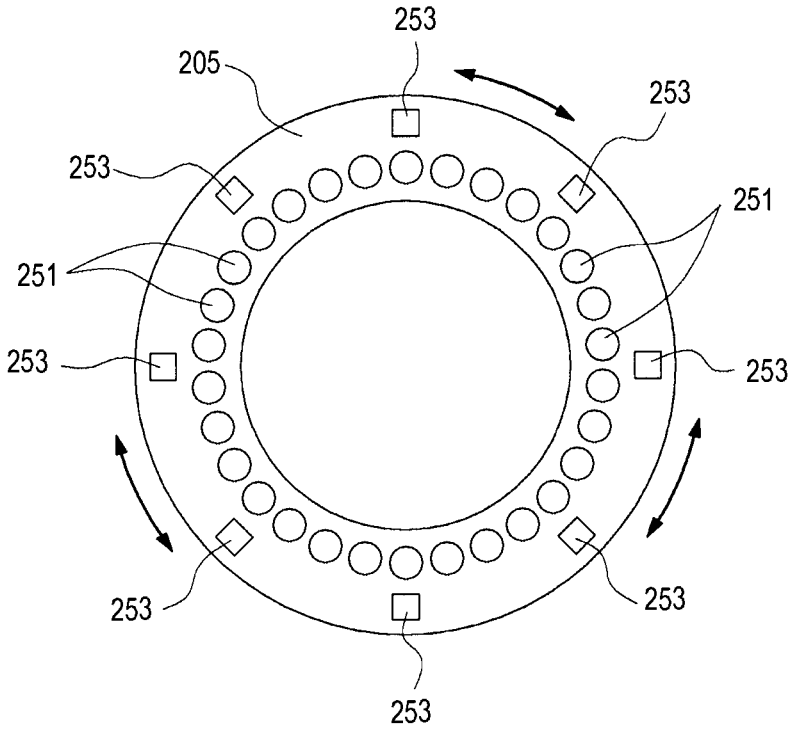
FIG. 8 is a rear view illustrating a bezel of an electronic device according to a fourth one of various embodiments of the present disclosure.

FIG. 7 is a front view illustrating a housing of an electronic device according to a third one of various embodiments of the present disclosure. FIG. 8 is a rear view illustrating a bezel of an electronic device according to a fourth one of various embodiments of the present disclosure.

Referring to FIGS. 7 and 8, the number of the elastic units 207 and the second grooves 251 may vary, unlike the above-described embodiments. For example, since the number of the elastic units 207 and the second grooves 251 according to the present embodiment are smaller than the number of the elastic units and the second grooves of the above-described embodiment, the elastic units 207 and the second grooves 251 according to the present embodiment can be made easier.

In addition, the sensor units 213 may be provided on the housing 201 to be spaced apart from each other around the elastic units 207. The magnets 253 may be provided on the bezel 205 to be spaced apart from each other around the second grooves 251. As the bezel 205 rotates, the sensor units 213 sense the degree of rotation of the bezel 205 by sensing a change in magnetic force emitted from the magnets 253.

In addition, according to various embodiments of the present disclosure, the sensor units 213 generate electrical signals according to the degree of rotation of the bezel 205, and the electrical signals can be transmitted to the control unit. The control unit may control a screen displayed on the display device 103 (FIG. 1) according to the electrical signals. For example, the display device 103 may display a first screen, and may receive an electrical signal from the control unit, thereby displaying a second screen. In addition, the display device 103 may display an object at a first position on the screen, and may receive the electrical signal from the control unit, thereby displaying the object in a state where the object is moved to a second position on the screen. The object may be an application displayed on the screen or a game item of a game application, which is driven.

Further, the electronic device according to various embodiments of the present disclosure may further include a vibration element (not illustrated). The vibration element may be configured with an electric motor. However, the vibration element is not limited to the electric motor, and may include various structures that generate vibration.

First, the bezel 205 may form a mark (not illustrated) on an outer face of the bezel 205. The mark may be in the form of a scale. However, the mark is not limited to a scale, and may be formed of various patterns and marks that can identify the rotation of the bezel 205 when the bezel 205 rotates.

In addition, the control unit may determine the position of the mark by measuring the degree of rotation of the bezel 205. When the bezel 205 rotates and the mark is disposed at a position corresponding to an object displayed on the display device 103, the vibration device may generate vibration after the control unit transmits an electric signal to the vibration device. For example, when the object is an item of a game application, the mark may be rotated to a position corresponding to the object through the rotation of the bezel, and the vibration element may transfer a result obtained by performing a mission of the game to the user by vibration feedback.

As described above, according to various embodiments of the present disclosure, the electronic device may include a housing; a display device mounted on one face of the housing; a bezel rotatably coupled to the housing and rotating along a periphery of the display device; and a plurality of elastic units provided in the housing so as to provide an elastic force to the bezel in a first direction.

In addition, according to various embodiments of the present disclosure, the elastic units may be disposed along a periphery of the display device.

In addition, according to various embodiments of the present disclosure, the bezel may include a plurality of grooves, which correspond to the elastic units, respectively.

In addition, according to various embodiments of the present disclosure, each of the elastic units may include a first elastic section, at least a portion of which has a curved face, and a second elastic section mounted in the housing and providing an elastic force to the first elastic section.

In addition, according to various embodiments of the present disclosure, the grooves may include a contact face formed in a curvature that is smaller than the curved face in the first elastic section.

In addition, according to various embodiments of the present disclosure, the electronic device may further include a plurality of magnets provided in one of the housing and the bezel, and a plurality of sensor units provided in a remaining one of the housing and the bezel, and sensing a magnetic force of the magnets. The sensor units may sense a degree of rotation of the bezel by sensing the magnetic force of the magnets.

In addition, according to various embodiments of the present disclosure, the electronic device may further include a control unit mounted on the housing and receiving an electrical signal from the sensor units, and the control unit may convert an electrical signal, which changes according to the rotation of the bezel, into an input signal for driving the electronic device.

In addition, according to various embodiments of the present disclosure, the electronic device may further include a wearing unit connected to the housing and detachably worn on the body of a user.

While the present disclosure has been shown and described with reference to certain embodiments thereof, it will be understood by those skilled in the art that various changes in form and details may be made therein without departing from the spirit and scope of the present disclosure as defined by the appended claims.

The invention claimed is:

1. An electronic device comprising:

a housing;

a display device mounted on one face of the housing and facing a first direction;

a bezel rotatably coupled to the housing and rotating along a periphery of the display device; and a plurality of elastic units provided in the housing so as to provide an elastic force to the bezel in the first direction, wherein each of the plurality of elastic units includes a first elastic section, at least a portion of which includes a curved face, and a second elastic section mounted in the housing and providing an elastic force to the first elastic section, and wherein the first elastic section is sequentially inserted into and separated from a plurality of grooves of the bezel by the elastic force of the second elastic section when the bezel is rotated to clockwise or counterclockwise along a periphery of the display device.

2. The electronic device of claim 1, wherein the elastic units are disposed along a periphery of the display device.

3. The electronic device of claim 2, wherein the bezel includes the plurality of grooves, which correspond to the elastic units, respectively.

4. The electronic device of claim 3, wherein the plurality of grooves includes a contact face whose radius of curvature is larger than a radius of curvature of the curved face in the first elastic section.

5. The electronic device of claim 1, further comprising:

a plurality of magnets provided in one of the housing and the bezel; and a plurality of sensor units provided in a remaining one of the housing and the bezel, and sensing a magnetic force of the magnets, wherein the sensor units sense a degree of rotation of the bezel by sensing the magnetic force of the magnets.

6. The electronic device of claim 5, further comprising:

a control unit mounted on the housing and receiving an electrical signal from the sensor units, wherein the control unit converts the electrical signal, which changes according to the rotation of the bezel, into an input signal for driving the electronic device.

7. The electronic device of claim 1, further comprising:

a wearing unit connected to the housing and detachably worn on a body of a user.

* * * * *